United States Patent [19]

van den Einden et al.

[11] 4,100,453

[45] Jul. 11, 1978

[54] ELECTRICAL CONNECTION OF ELECTRODES IN MULTIPLE GUN ELECTRODE STRUCTURE

[75] Inventors: Henricus Fransiscus Petrus van den Einden; Djuurd Anne Geertruid Kamerbeek; Franciscus Jacobus Rimmelzwaan, all of Eindhoven, Netherlands

[73] Assignee: U.S. Philips Corporation, New York, N.Y.

[21] Appl. No.: 736,855

[22] Filed: Oct. 29, 1976

[30] Foreign Application Priority Data

Sep. 24, 1976 [NL] Netherlands ..... 7610609

[51] Int. Cl.[2] ..... H01J 29/50; H01J 29/02

[52] U.S. Cl. ..... 313/417; 313/257

[58] Field of Search ..... 313/417, 414, 457

[56] References Cited

U.S. PATENT DOCUMENTS

| | | | |
|---|---|---|---|
| 3,238,409 | 3/1966 | Brown | 313/417 X |
| 3,517,242 | 6/1970 | Pappadis | 313/414 |
| 3,745,397 | 7/1973 | Yamazaki et al. | 313/417 |
| 3,838,306 | 9/1974 | Jenne | 313/417 X |

*Primary Examiner*—Robert Segal

*Attorney, Agent, or Firm*—Frank R. Trifari; Algy Tamoshunas

[57] ABSTRACT

An electron gun system constructed of three electron guns for a color television display tube comprises at least one electrode in each gun located alongside, and electrically connected to, the corresponding electrodes in the other guns. The electrodes are positioned with respect to each other by means of metal braces which are secured thereto and the free ends of which are secured in pairs in insulating supporting members. The electrical interconnection of at least one group of such electrodes is achieved by means of at least two contact springs which are each inserted between one pair of braces secured to adjacent electrodes in the group and to a common insulating member. The springs are inserted after assembly of the guns and are held in place by physical interference with the braces they engage.

5 Claims, 5 Drawing Figures

ELECTRICAL CONNECTION OF ELECTRODES IN MULTIPLE GUN ELECTRODE STRUCTURE

Figure 1:
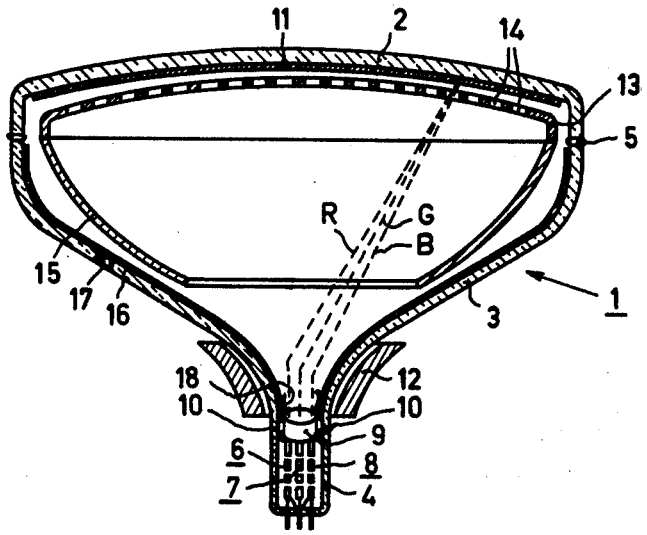

The invention relates to a multiple electron gun system for a colour television display tube including three electron guns each extending along a longitudinal axis, and comprising at least one group of three corresponding electrodes connected together electrically, of which electrodes the mutual position is fixed by metal braces which are secured to each of the said electrodes and the free ends of which are connected pairwise in supporting rods consisting of an insulating material.

The invention furthermore relates to a colour television display tube having such an electron gun system.

In a multiple electron gun system of the type equipped with three electron guns having similar electrode structures, certain electrodes should convey the same potential during operation of the electron gun system. In practice this is realized by connecting the relevant electrodes, sometimes referred to as corresponding electrodes, together electrically.

In a multiple electron gun system disclosed in U.S. Pat. No. 3,838,306, said electrical connection consists of a thin metal ribbon which is welded either to the corresponding electrodes themselves, or to the metal connection braces of said electrodes. Said welding operations are carried out prior to the assembly of the gun system so that a packet of three corresponding electrodes connected together by one or more ribbons is obtained.

For several reasons it is recommendable to minimize the number of welding operations for an electron gun system. First, due to the compact structure of the gun system it is in certain cases not possible to mechanize such welding operations so that said operations become very labour-intensive. Secondly, during welding damage of the components to be welded may occur, which is undesired in particular when the component in question is an electrode which is subject to narrow tolerances. As a matter of fact, during assembly of the gun system the electrodes are slipped on three assembly pins arranged in a fixed relationship to each other. Damage on the inside of an electrode, for example, in the form of an uneveness resulting from a welding operation, may avoid an accurate centring of the electrode on the pin and may in addition impede the slipping of the electrode onto the assembly pin. A further problem in the known construction is that the corresponding electrodes connected to form a packet must be slipped simultaneously on the three assembly pins. In particular when the play between the inner wall of the electrodes and the centring surfaces of the assembly pins is small, this a time-consuming and difficult operation, the more so because the assembly pins are usually arranged to be slightly converging.

It is an object of the invention to provide a multiple electron gun system in which the electric interconnection of a group of corresponding electrodes is realized in a simple manner without performing a welding operation for that purpose.

According to the invention, a multiple electron gun system of the kind mentioned in the preamble is characterized in that the corresponding electrodes of at least one group are connected together electrically by means of at least two metal contact springs which are each clamped between two braces secured to adjacent electrodes in the group. Said contact springs are provided after assembling the gun system namely preferably between two substantially parallel parts of two braces secured to adjacent electrodes in the group.

In addition to the advantage that no welding operations are necessary for the electric interconnection of the corresponding electrodes, the invention moreover has the advantage that the corresponding electrodes can each individually be slipped on the assembly pins, which facilitates the assembly of the gun system. Another great advantage is that the invention may be used without taking additional measures both in a gun system in which the axes of the three guns are located in one plane (also termed the "in-line configuration"), and in a gun system in which the axes of the three guns each pass through a corner point of an equilateral triangle (also termed the "delta configuration").

According to the invention, each metal contact spring consists preferably of a ribbon which is bent to form substantially a V. A possible locking against jumping-out of the contact spring has proved to be not strictly necessary, and in particular is not necessary when the limbs of the V-shaped ribbon have unequal lengths and the end of the short limb is slightly bent outwards so that said end presses against the surface of a connection brace with a sharp edge. The end of the long limb of the contact spring is preferably bent laterally so that an abutment is obtained which restricts the depth of insertion of the spring.

Figure 4:
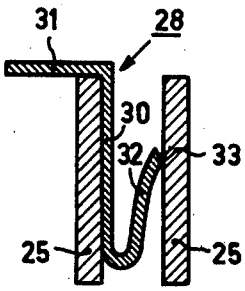
Figure 5:
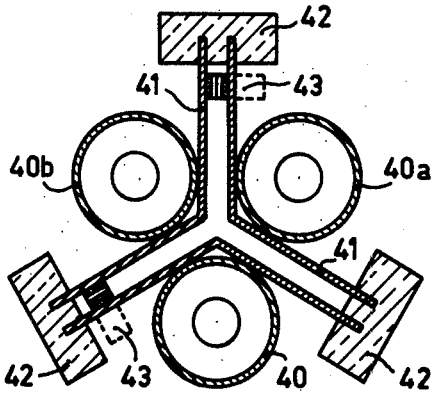
Figure 2:
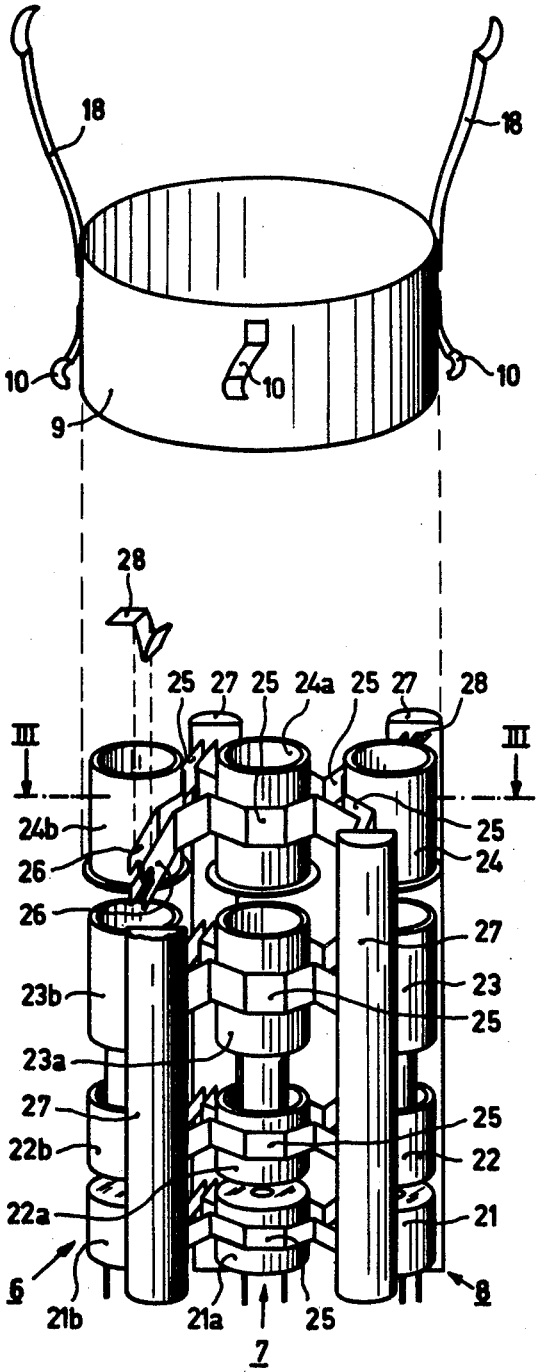
Figure 3:
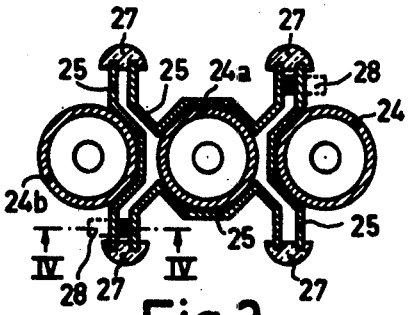

The invention will be desired in greater detail with reference to the drawing, in which FIG. 1 is a sectional view of a colour television display tube having a multiple electron gun system with three electron guns arranged in in-line configuration of which a group of corresponding electrodes according to the invention are interconnected together electrically, FIG. 2 is a perspective view of the electron gun system of the tube shown in FIG. 1, FIG. 3 is a sectional view taken on the line III—III of FIG. 2, FIG. 4 is a sectional view taken on the line IV—IV of FIG. 3, and FIG. 5 is a sectional view analogous to that of FIG. 3 but this time of a gun system having three electron guns arranged in delta configuration.

The colour television display tube shown in FIG. 1 comprises a glass envelope 1 including a glass window 2, a glass cone 3 and a glass neck 4. The window 2 is secured to the cone 3 by means of a sealing glass 5. Situated in the neck 4 is a multiple electron gun system comprising three electron guns which are arranged according to the "in-line configuration" and are denoted by 6, 7 and 8 for generating three electron beams denoted by R, G and B. The gun system is centred in the neck 4 by means of centring sleeve 9 secured to the gun system and having centring springs 10 and contact springs 18. The contact springs 18 contact an electrically conductive layer 16 provided on the inside of the cone wall and connected to a high voltage contact 17 provided in the cone wall. On their way to a display screen 11 provided on the inside on the window 2, the electron beams R, G and B are deflected by a system 12 of deflection coils arranged coaxially around the tube axis. The display screen 11 consists of a large number of regions luminescing in red, green and blue. In the case under consideration of a three in-line arrangement of the electron guns 6, 7 and 8, said luminescent regions consist of phosphor strips the longitudinal direction of which is at right angles to the plane through the guns.

In the case of a delta arrangement of the electron guns said luminescent regions usually consist of triplets of phosphor dots. In order that the three electron beams each impinge only upon luminescent regions of one colour, there is arranged at a short distance before the display screen 11 a colour selection electrode 13 in the form of a thin metal sheet having a large number of apertures 14 which are positioned accurately with respect to the luminescent regions of the display screen 11. The electron beams R, G and B pass through the apertures 14 at a small angle with each other and consequently each impinge only upon luminescent regions of one colour. A metal cone 15 is furthermore present in the tube with which the electron beams R, G and B are screened from the earth's magnetic field.

For a good operation of the electron gun system it is necessary for certain electrodes of the three electron guns 6, 7 and 8 to be interconnected electrically. FIGS. 2 and 3 show in what manner this can be realized for a group of corresponding electrodes which are subjected to very narrow tolerances. Each of the three guns of the gun system shown in FIG. 2 comprises a control electrode 21 (also referenced $G_1$), an anode 22 (also referenced $G_2$), a focussing electrode 23 (also referenced $G_3$) and an accelerating electrode 24 (also referenced $G_4$). In each space surrounded by the beaker-like control electrodes 21 there is a cathode which is arranged so as to be electrically insulated with respect to said control electrode, the cathode being not visible in the drawing. The electrodes of the three guns 6, 7 and 8 are positioned with respect to each other by means of metal braces 25 which are welded thereto and the free ends 26 of which are embedded in four glass rods 27 in such manner that of two adjacent electrodes the free ends of the braces 25 secured thereto are embedded pairwise in the rods 27. The gun system comprising two groups of three corresponding electrodes, namely a first group formed by the electrodes 24, **24*a*, 24*b* and a second group formed by the electrodes 23, 23*a* and 23*b*. The electrodes 24, 24*a* and 24*b* are connected together electrically by means of two V-shaped contact springs 28. Said contact springs 28, after assembly of the electron gun system, are forced between two substantially parallel end portions of the braces 25. Assembly of the gun system is to be understood to mean herein: slipping the electrodes 21 to 24 of the three guns 6, 7 and 8 on three assembly pins, pressing the ends of the braces 25 in the glass rods 27 which for that purpose are heated locally to the softening temperature of the glass of which they consist, and then cooling the glass rods 27. The braces 25 of the electrodes 24, 24*a* and 24*b* are connected together electrically and consequently also to the electrodes themselves by means of the contact springs 28**.

FIG. 2 shows clearly how the contact springs 28 are provided in place. This is shown again in FIG. 3 which is a perpendicular sectional view taken on the line III—III of FIG. 2. Although the contact springs are arranged diagonally with respect to the electrode **24*a*, it will be obvious that the two contact springs can also be arranged between two pair of braces present on one side of the plane through the axes of the electrodes 24, 24*a*, 24*b*. The corresponding electrodes 23, 23*a* and 23*b* are connected together electrically in an analogous manner by means of two connection contact springs. If desired, however, a known manner of interconnection may be used for this group of electrodes, for example, in the form of interconnection ribbons welded to the electrodes. Although as a result of these welded ribbons, unevenesses may be formed on the inner surface of the electrodes 23, 23*a* and 23*b*, said unevenesses have no influence of any significance on the path which is followed by the electrons of the beams R, G and B, provided the distance of said unevenesses to the edge of the electrodes 23, 23*a* and 23*b* present near the electrodes 24, 24*a* and 24*b* be at least approximately 4 mm. This also applies in relation to the place where the braces 25 are welded to the electrodes 23, 23*a* and 23*b*. The unevenesses as a result of the welding of the braces 25 to the electrodes 24, 24*a* and 24*b*, however, should be removed because the choice with respect to the place of the braces is restricted as a result of the usually smaller axial dimensions of said electrodes with respect to the electrodes 23, 23*a* and 23*b***.

After forcing the contact springs 28 between the braces 25, the centering sleeve 9 is welded to the gun system. The centering sleeve 9 is usually welded to four lugs present on the braces 25 secured to the electrode **24*a***. In order to avoid complexity of the drawing, however, said lugs are not shown.

FIG. 4 is a perpendicular sectional view taken on the line IV—IV of FIG. 3 in which the shape of a contact spring 28 is clearly shown. The contact spring 28 consists of a ribbon of chrominium nickel steel which is bent to form substantially a V and has a width of approximately 2 mm and a thickness of approximately 0.15 mm. The limbs of the V-shaped ribbon have unequal lengths. The long limb 30 has a laterally bent end 31, whereas the short limb 32 is slightly bent outwards so that the end thereof presses against the surface of one of the braces 25 with a sharp edge 33. The sharp edge 33 prevents the contact spring 28 from jumping out between the braces 25, while the laterally bent end 31 limits the depth of insertion of the contact spring 28.

FIG. 5 is a sectional view analogous to that of FIG. 3 but this time for a multiple electron gun system of which the electron guns are arranged at the corners of an equilateral triangle. In a similar manner as described above, three corresponding electrodes 40, **40*a* and 40*b* are fixed with respect to each other by means of three metal braces 41 the ends of which are embedded pairwise in three glass rods 42. The electrical connection of the electrodes 40, 40*a* and 40*b* is realised by two contact springs 43** in a manner as described above.

What is claimed is:

1. A multiple electron gun system for a color display cathode ray tube comprising three electron guns extending substantially parallel to each other and to a longitudinal axis of said tube, each of said guns comprising at least one electrode located in the same region along said axis as the corresponding said electrode of each of the other of said guns, a plurality of rigid insulating support members, a pair of conductive braces connected, respectively, to two of said corresponding electrodes and rigidly engaging a first one of said insulating support members and extending alongside each other in a region between said two corresponding electrodes and said first one of said insulating support members, said multiple electron gun system comprising: a resilient conductive contact ribbon-shaped spring having substantially greater width than thickness, said spring being bent generally V-shaped to bring first and second surface portions thereof into juxtaposition with each other, said generally V-shaped spring being compressed between said pair of braces and extending substantially parallel to said axis, at least one portion of one leg of said ribbon-shaped spring making contact with a first one of said braces at points thereof spaced apart by a distance substantially equal to the width of said ribbon-shaped spring, and a portion of the second leg of said apring being bent slightly outwardly against the other brace of said pair of braces, said second leg having the free end engaging said other brace of said pair of braces and exerting resilient and frictional pressure thereagainst to hold said spring in engagement with said pair of braces.

2. A multiple electron gun system as claimed in claim 1 in which the end of said one leg of said ribbon-shaped spring is bent away from said second leg to comprise means hooked over said first one of said braces to limit insertion of said spring in the axial direction.

3. A multiple electron gun system as claimed in claim 1 in which said free end engaging the other brace has a sharp edge.

4. A multiple electron gun system as claimed in claim 1 in which said guns have respective axes lying in a common plane.

5. A multiple electron gun system as claimed in claim 1 in which said guns have respective axes lying at corners of an equilateral triangle.

* * * * *